United States Patent [19]

Bekedam

[11] 4,258,668

[45] Mar. 31, 1981

[54] CLOSED PRESSURIZED FEED WATER SYSTEM SUPPLYING FLASH STEAM TO A LOWER PRESSURE PROCESS

[76] Inventor: Martin Bekedam, 106 Zander Dr., Orinda, Calif. 94563

[21] Appl. No.: 972,796

[22] Filed: Dec. 26, 1978

[51] Int. Cl.[3] ..... F22D 33/00

[52] U.S. Cl. ..... 122/1 R; 122/1 C; 122/412; 122/451 R

[58] Field of Search ..... 122/1 R, 1 C, 406 R, 122/412, 451 R

[56] References Cited

U.S. PATENT DOCUMENTS

| | | | |
|---|---|---|---|
| 3,420,054 | 1/1969 | Sheldon | 122/1 R |
| 3,789,806 | 2/1974 | Gorzegno | 122/406 S |
| 3,937,024 | 2/1976 | Durrant et al. | 122/451 R |

*Primary Examiner*—Anthony V. Ciarlante

*Attorney, Agent, or Firm*—Alvin E. Hendricson; William R. Piper

[57] ABSTRACT

A closed pressurized feed water system supplying flash steam to a lower pressure process and with no steam loss in the closed system. The flash steam delivered to the lower pressure process is sufficient to reduce the pressure in the feed water system so that a steam trap in the closed system will operate and permit the hot condensate to be returned to the boiler. Also, new make up water may be added to the system to compensate for any steam loss. In the high pressure closed system about 96.68% of the condensate is returned to the boiler and only about 3.32% is needed for new make up water.

2 Claims, 2 Drawing Figures

FIG. 1
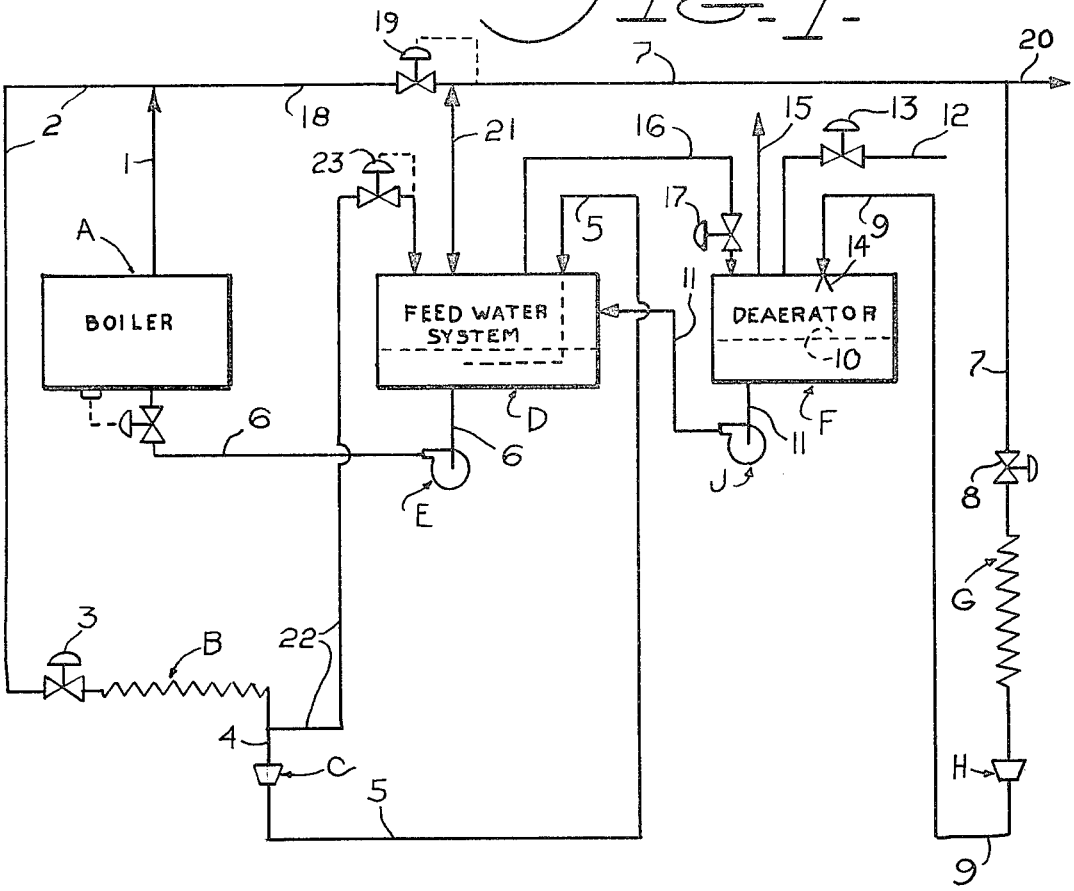
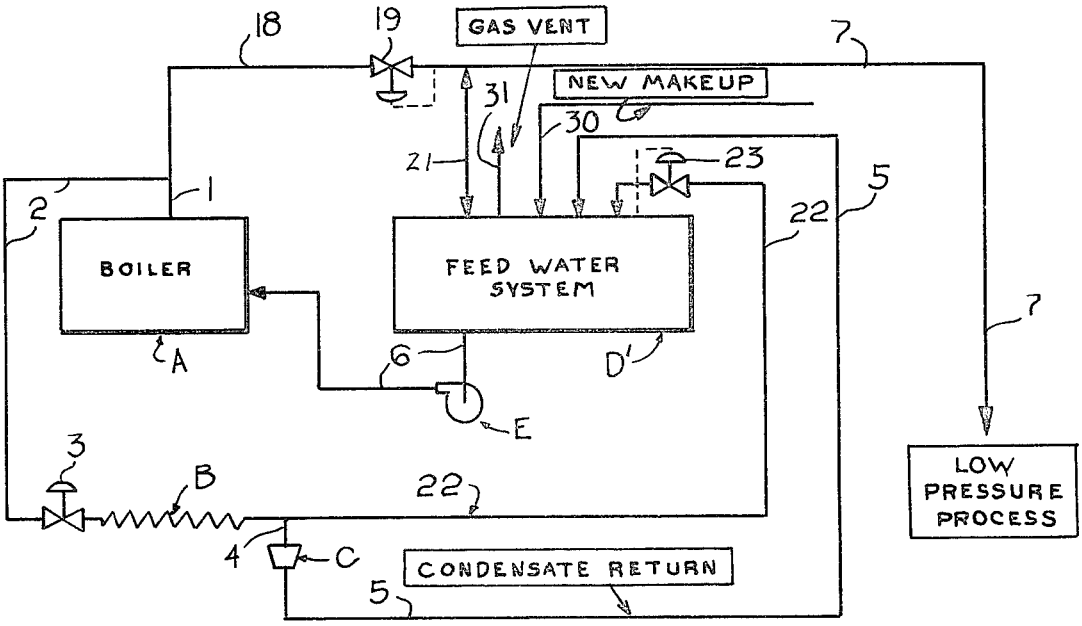
FIG. 2

CLOSED PRESSURIZED FEED WATER SYSTEM SUPPLYING FLASH STEAM TO A LOWER PRESSURE PROCESS

SUMMARY OF THE INVENTION

Present high steam pressure systems have flash steam loss due to the pressure drop required to return the condensate through steam traps or other control methods. This is due to the high temperature condensate being blended with a small amount of 70° F., new make up water that is insufficient to bring the temperature and pressure of the condensate down enough to create a pressure drop sufficient to make a steam trap operate properly and overcome the loss in the condensate return line. The pressure drop required to make the system work will vary according to how far removed the boiler room equipment is from the process plant.

An object of my invention is to provide a closed pressurized main feed water system in which the pressure drop is controlled without loss of any flash steam in the main system because the pressure drop in the main system is attained by removing steam from the feed water system and feeding it to the lower pressure process. The pressure drop through the closed system is controlled without the need for using any high temperature pumps to return the condensate.

BRIEF DESCRIPTION OF THE DRAWING

FIG. 1 is a schematic illustration of my closed pressurized feed water system using a deaerator as a part of the system and the one receiving the new make up water.

FIG. 2 shows a modified closed pressurized feed water system in which the deaerator is not used.

DESCRIPTION OF THE PREFERRED EMBODIMENTS

In carrying out my invention, I show a steam boiler A for generating steam at a temperature of 387.89° F., and a pressure of 200.3 PSIG, see FIG. 1. The steam is conveyed through steam pipes 1 and 2 to any type of high pressure process indicated schematically at B. A valve 3 controls the flow of steam into the high pressure process B. The condensate leaving the high pressure process B, through the line 4 has a temperature of 387.89° F., and it is forced through a steam trap C shown diagrammatically in FIG. 1. A condensate line 5 leads from the steam trap C to a feed water system shown at D. A boiler return line 6 including a pump E, returns the condensate back to the boiler A to complete the closed circuit in my system. Processes that have a low percentage of lost steam require a low percentage of new make up water.

The following illustration will be helpful. Assume an operating steam pressure at 387.89° F., and 200.3 PSIG, and we wish to return 96.68% as a condensate back to the boiler A at 387.89° F., and add 3.32% new make up water at 70° F.

| | | | |
|---|---|---|---|
| Return condensate 387.89° F. × | 96.68% | = | 37501.2 |
| Make up water 70° F. × | 3.32% | = | 232.4 |
| | 100% | | 37733.6 |

Divide: 37733.6÷100 =377.3° F., at approximate 179 PSIG.

200.3 PSIG (original steam pressure)−179 PSIG=21.3 PSIG pressure drop.

This is an insufficient pressure drop to make the closed system operate.

The 179 PSIG steam pressure, if flashed down to a ten pound pressure, will result in a flash steam loss of about 14% of the total steam produced. With my system of no flash steam loss, this waste of 14% of the steam is saved.

A condensate of 200.3 PSIG flashed down to 375° F. at 170 PSIG=3.32%.

| | | | |
|---|---|---|---|
| 375° F. × | 96.68 | = | 36255 |
| 70° F. × | 3.32 | = | 232 |
| | 100% | | 364.87 → 365 = 150 PSIG |

200.3 PSIG−150 PSIG=50.3 PSIG drop.

There are pressurized condensate systems in use that have high temperature transfer pumps in the system to return the condensate back to the pressurized receivers or boiler. These systems required a pump and closed condensate receivers in the plant for each operating pressure in the process.

With my closed high steam pressure system the flash steam produced from my pressurized receiver in the boiler room will control the pressure drop from the discharge of the traps to the pressurized receiver from all of the high pressure processes so that no pumps will be required. In FIG. 1 I show the high pressure process B, and the steam trap C. The hot condensate in the pipe 5 from the steam trap flows into the feed water system D and steam will be flashed from the condensate within feed water system.

The flash steam removed from the feed water system D flows through a pipe 21 and then through a pipe 7 to a low pressure process G, and this steam is controlled by a valve 8, see FIG. 1. A steam trap H controls the hot condensate from the low pressure process G, and directs this condensate in a line 9 to the deaerator F. The type of deaerator used is the one disclosed in my U.S. Pat. No. 3,487,611, issued Jan. 6, 1970, and entitled "Spray Flow Deaerator." The water level in the deaerator F, is shown at 10 and a pump J, in a line 11 removes the condensate from the deaerator and delivers it to the feed water system D and from there the condensate is returned to the boiler A by the line 6 and pump E.

New make up water at 70° F., is delivered to the deaerator F as required by a fresh water line 12 controlled by a valve 13. The fresh water line 12 enters the deaerator and has a spray nozzle 14 that causes the fresh water to enter the hot condensate in the deaerator. The deaerator F has an outlet pipe 15 for permitting the non-condensable gases to escape from the deaerator. Also, steam can be fed from the feed water system D into the deaerator F by a line 16 that is controlled by a valve 17. There is a branch steam line 18 connecting the steam line 1 to the feed water system D by a line 21 and a valve 19 is placed in the line 18. FIG. 1 further shows another steam line 20 leading from the steam pipe 7 for conveying steam that is used for any purpose where there is no condensate return back to the boiler. The purpose of the steam line 18 leading from the boiler A and steam pipe 1 to the feed water system D, is to control the steam pressure in the feed water system D and add sufficient steam for a stable operation.

The present closed pressurized feed water system can be applied to any process equipment from which condensate is to be returned to the steam boiler A without any loss from flash steam regardless of the type of condensate drainage installed such as steam traps systems, closed cascading systems or systems using orifices. When condensate is removed from a process in a system that also removes some steam in order to remove the carbon dioxide $CO_2$, my closed system will salvage this steam as it is returned to the pressurized receiver and then the steam is reused at a lower operating steam pressure. There are many systems in operation that are flashing steam from the hot condensate in the process plant through flash receivers, but none that first take the condensate back to the feed water receiver in the boiler room and then flash off the steam in the feed water system D to create a pressure drop so that the condensate can be returned to the feed water system without the use of any pumping. Then the steam is returned through the separate line 7 for use at the lower pressure process G. My system can be applied to any process that has a condensate return such as paper corrugators, paper mills, plywood dryers, rendering plants, textile plants, rubber plants, chemical plants, etc.

With my present closed pressurized system the pressure drop is contolled without any steam flash loss and this is due to supplying this flash steam from the feed water system D through the line 7 to the lower pressure process G, shown in FIG. 1. The pressure drop in the feed water system D, is sufficient to cause the steam trap C to operate and return the hot condensate to the feed water system through the line 5. The flash steam plus steam from the boiler A can be supplied when required through the line 18, controlled by the valve 19.

In order to produce the best quality steam from the boiler A, it is better to deaerate the new make up water and then add this water below the water level in the feed water system D so that the corresponding water temperature in the pressurized receiver will be below the corresponding pressure to prevent the boiler feed water pump E from flashing.

The novelty of my closed pressurized steam and condensate system is to create a maximum pressure drop in the boiler feed water system with a minimum amount of new make up water being added. A balanced pressure line 21 interconnects the pressurized feed water system D, and the lower operating pressure steamk line 7 to insure a stable operation. A steam and gas removal line 22 connects to the process B outlet line 4 and communicates with the feed water system D, and its flow is controlled by a valve 23 for increasing the efficiency of heat transfer in the process B.

In FIG. 2 I show a slightly modified form of the closed system shown in FIG. 1. The deaerator F, shown in FIG. 1 is not used in FIG. 2. The new make up water is added directly to the feed water system D′ through a fresh water pipe 30. The closed modified system of FIG. 2 in all other respects is the same as that shown in FIG. 1 and similar parts are given like reference numerals, etc. A gas removal line 31 connects with the feed water system D for removing gases from the system.

Although I mention a trap C, in FIG. 1, I could use an orifice which controls the condensate flow or a control valve with a liquid level control. I therefore use the word steam trap in a generic sense to include these other controls.

I claim:

1. A closed pressurized water system for a boiler with no flash steam heat loss in the high pressure system and supplying flash steam to a lower pressure process, comprising:

(a) a boiler;

(b) a high pressure process with a steam line interconnecting it with the boiler;

(c) a first steam trap for receiving condensate from the high pressure process;

(d) a feed water system having a pressure vessel with a first condensate line interconnecting it with said steam trap for returning the condensate from said trap to said feed water system;

(e) means for feeding fresh make up water to said feed water system;

(f) means for removing a predetermined amount of flash steam from said feed water system and delivering it to a lower pressure process;

(g) whereby a sufficient pressure drop in said feed water system is attained to cause said steam trap to function and return the hot condensate back to the feed water system from the high pressure process; and (h) means for returning the hot condensate from said feed water system back to said boiler to complete the closed system without any flash steam loss in the high pressure system.

2. The combination set forth in claim 1: and in which (a) the means for feeding fresh make up water to said feed water system includes a deaerator through which the fresh water passes; and (b) the means for removing the flash steam from said feed water system including means connecting the feed water vessel to said deaerator to heat the water in the deaerator and means delivering flash steam to the lower pressure process has a second steam trap and a second condensate line for returning the condensate from the second trap to the deaerator, and pumping means delivering condensate from the deaerator into the feed water system for return to the boiler.

* * * * *